United States Patent [19]

Kennedy, deceased et al.

[11] Patent Number: 5,012,873

[45] Date of Patent: May 7, 1991

[54] DEVICE FOR FORCING A REFLECTIVE HIGHWAY POST INTO THE GROUND

[75] Inventors: Ralph Kennedy, deceased, late of Pickerington, by Barry D. Cheney, executor; Ralph W. Kennedy, Pataskala, both of Ohio

[73] Assignee: Ampsco Corporation, Columbus, Ohio

[21] Appl. No.: 379,750

[22] Filed: Jul. 14, 1989

[51] Int. Cl.[5] ..... E21B 7/02

[52] U.S. Cl. ..... 173/22; 173/53; 173/31; 405/50; 405/232

[58] Field of Search ..... 173/22, 28, 25, 31, 173/53; 405/232, 50

[56] References Cited

U.S. PATENT DOCUMENTS 3,887,017 6/1975 Frederick ..... 173/22 X 4,755,080 7/1988 Cortlever et al. ..... 173/22 X

*Primary Examiner*—Douglas D. Watts

*Assistant Examiner*—Willmon Fridie, Jr.

*Attorney, Agent, or Firm*—John L. Gray

[57] ABSTRACT

A mobile device for forcing a highway post into the ground in the vertical position, especially where the highway post is flexible and made of fiberglass, which involves a vertical column spaced from and supported by the mobile device, guide means mounted on the vertical column to hold a reflective highway post in a vertical position while the post is forced into the ground by repetitive blows from a hydraulically driven hammer and means for moving the vertical column and the guide means upwards in a vertical direction when the post has been forced a sufficient distance into the ground.

8 Claims, 4 Drawing Sheets

DEVICE FOR FORCING A REFLECTIVE HIGHWAY POST INTO THE GROUND

BACKGROUND OF THE INVENTION

Metal highway posts containing a reflective element which are inserted in the ground along highways to indicate the edge of the berm are in common use. Frequently these are hit by moving vehicles and rendered inoperative.

As a consequence, a fiberglass post having an upper reflective portion has been developed which will spring back into a vertical position if a vehicle runs over it, provided that a wheel of the vehicle does not hit the post. Because of the inherent flexibility of such fiberglass posts it is extremely difficult to force them into the ground. The currently accepted technique is to utilize a weighted, hollow steel member slightly larger than the fiberglass post which is provided with handles so that the post may be manually driven into the ground. The disadvantages of this unit are that the lower portion of the post is not held in position adjacent to the place where it enters the ground during the driving operation and it is extremely difficult to keep the post in a perfectly vertical position during this operation. Furthermore, it is a time consuming, labor intensive task.

SUMMARY OF THE INVENTION

Applicant has devised a mobile device for forcing a reflective highway post into the ground which preserves the post in vertical alignment and holds the post in a rigid condition while it is being mechanically driven into the ground.

It is therefore an object of this invention to provide a mobile fluid power actuated device for forcing a reflective highway post into the ground.

It is a further object of this invention to provide such a device which will maintain the highway post in a vertical position regardless of the irregularities of the terrain.

It is an additional object of this invention to provide such a device which enables the post to be forced into the ground rapidly and accurately.

These, together with other objects and advantages of the invention will become more readily apparent to those skilled in the art when the following general statements and descriptions are read in the light of the appended drawings.

DETAILED DESCRIPTION OF THE DRAWINGS

Figure 1:
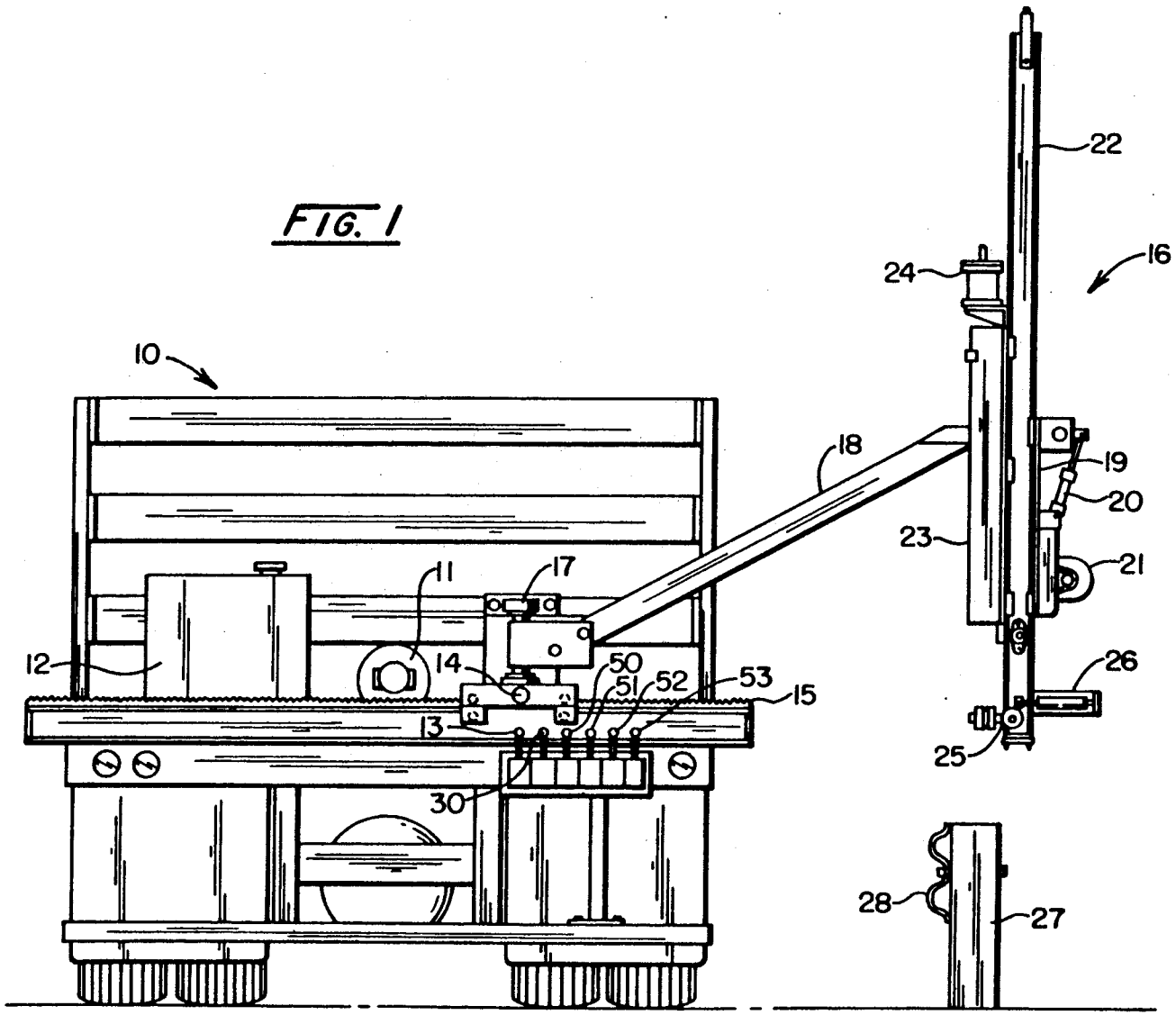
FIG. 1 is a rear elevation view of the mobile device for forcing a reflective highway post into the ground.

Referring now more particularly to the drawings, the mobile unit is shown generally at 10 and in this instance is a flatbed truck. The flatbed truck 10 is provided with a hydraulic pump 11 which is driven by the main engine of the vehicle through an electric actuated hydraulic clutch (not shown) to provide hydraulic fluid from hydraulic reservoir 12. The various fluid connections are not shown in these figures but are shown in the schematic drawings in FIG. 6. The valve 13 operates hydraulic motor 14 which may be used to position the post to be driven into the ground by moving the entire post driving assembly on the rack 15 in either direction depending upon the position of the valve 13. The entire post driving assembly indicated generally at 16 is moved manually to either side of the truck 10 by revolving it on vertical column 17 and is supported on the truck 10 by arm 18, which is connected to plate 19 which supports hydraulic cylinder 20 and hydraulic motor 21. Column 22 is slidably mounted in plate 19 and also supports guides 23—23, hydraulic hammer 24, and guide rollers 25—25, which rollers 25—25 are moved from an open to a closed position by means of hydraulic cylinder 26. Hydraulic motor 21 is used to move column 22 and its attachments upward or downward. Hydraulic cylinders 20 and **20*a* (see FIGS. 2 and 3) are used to achieve vertical alignment of column 22** and thus of the posts being forced into the ground.

A typical highway guardrail post 27 is shown with a typical guardrail 28 attached thereto with the apparatus shown positioned above the guardrail 28 since the reflective highway posts quite often are placed in between the guardrail posts 27—27. Hydraulic hammer 24 is controlled by valve 30.

Figure 2:
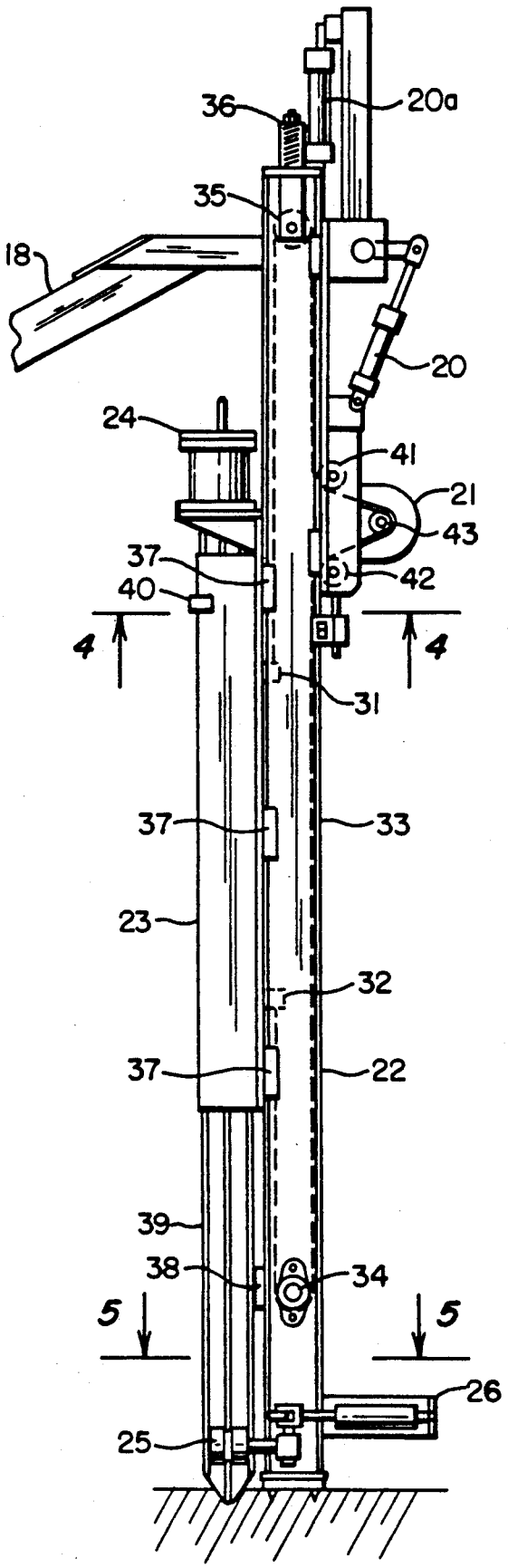
FIG. 2 is a rear elevation view of the vertical column and drive means and hammer means used to force the post into the ground.
Figure 3:
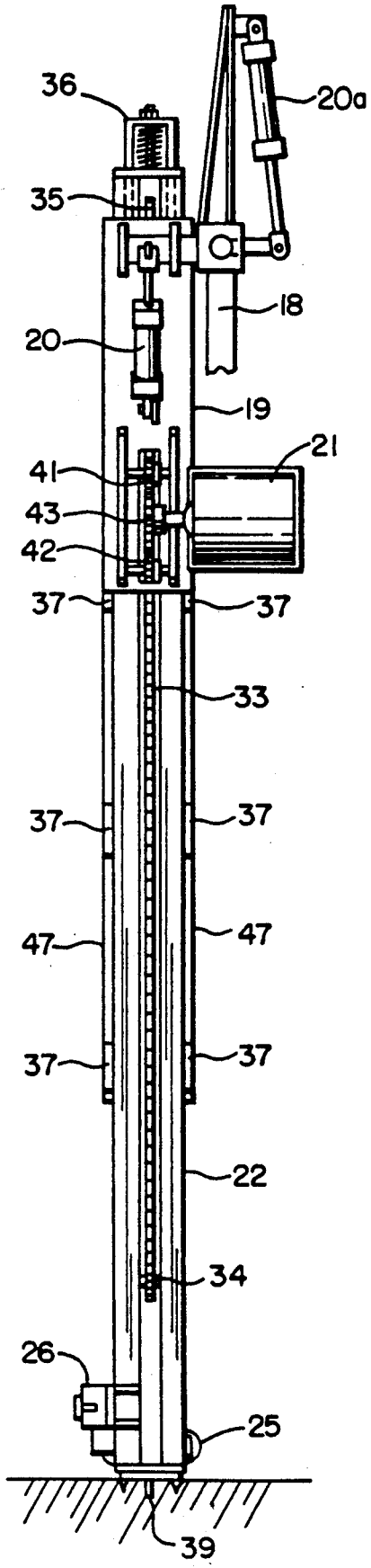
FIG. 3 is a side elevation view of the same unit.

Referring now more particularly to FIGS. 2 and 3, it will be seen that hydraulic motor 21 is positioned to slide on column 22 and is connected to column 22 at points 31 and 32 by means of chain 33 which passes over idler sprockets 34 and 35 and is held in tension by means of spring 36. Guides 23—23 are slidably positioned on column 22 by means of members 37—37 and have a lower stop 38 limiting their downward movement. The guides 23—23 are open to receive the highway post 39 which is held in place at its upper end by means of member 40 connecting the guides 23—23 together. The lower portion of highway post 39 is guided into the ground by means of rollers 25—25. It should be noted that chain 33 passes over idler rollers 41 and 42 and is driven by sprocket 43 which is attached to motor 21.

Figure 4:
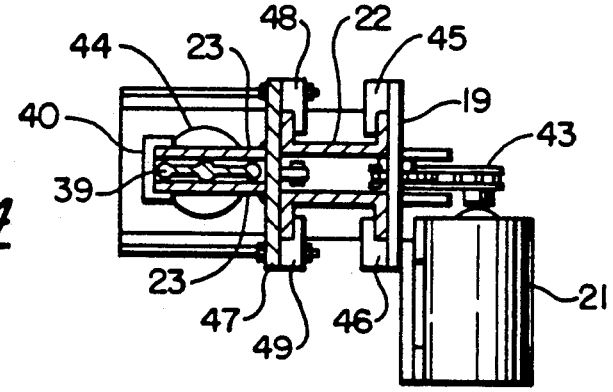
FIG. 4 is a section of the device shown in FIG. 2 taken on the section line 4—4.

Referring now more particularly to FIG. 4, it will be seen that the hydraulic hammer 24 has a base 44 which is used to hammer and force the highway post 39 into the ground between the guides 23—23. As shown in FIG. 4, motor 21 is positioned on plate 19 and slides 45 and 46, and slides on column 22, which is generally in the form of a hollow I-beam, whereas guides 23—23 are attached to a base 47 which slides on slides 48 and 49 on column 22.

Figure 5:
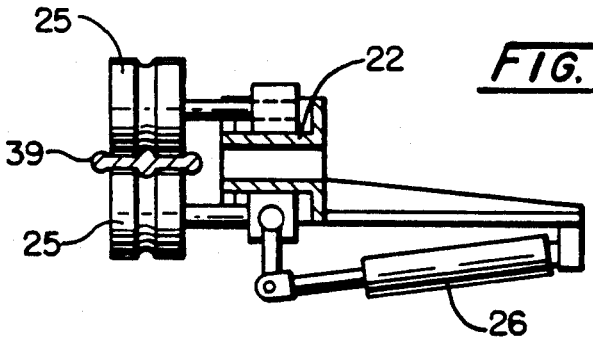
FIG. 5 is a section of the device shown in FIG. 2 taken on the section line 5—5.
Figure 6:
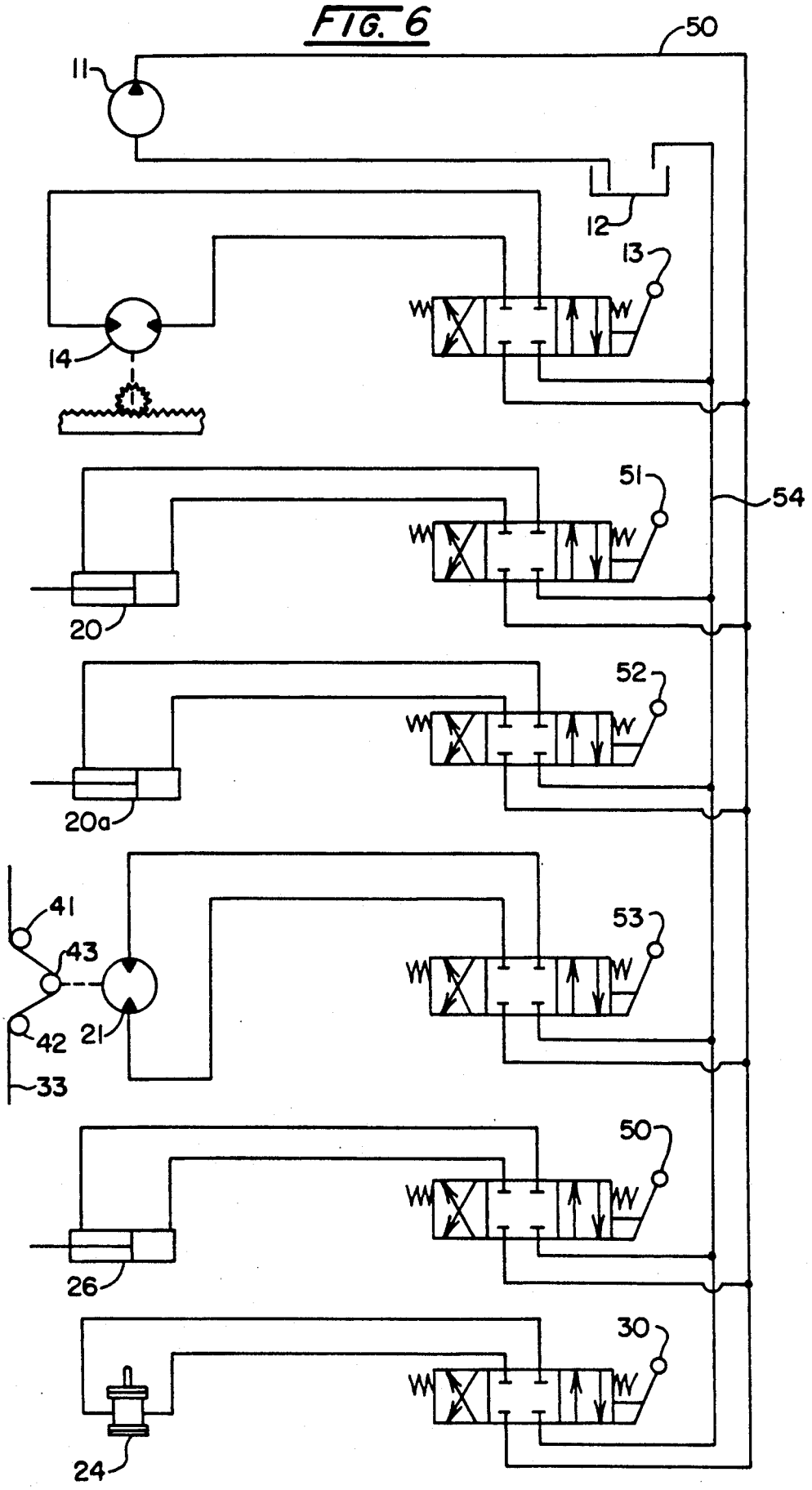
FIG. 6 is a schematic rendering of the hydraulic system.

Referring now more particularly to FIG. 5, it will be seen that hydraulic cylinder 26 is used to open or close guide rollers 25—25 to hold the lower portion of highway post 39 in position adjacent the ground and is controlled by valve 50 shown in FIGS. 1 and 6.

Referring now more particularly to FIG. 6, hydraulic pump 11 provides hydraulic fluid under pressure through line 50 to control valves 13, 30, 50, 51, 52, and 53. These are all four-way valves so that the direction of the hydraulic unit being controlled may be reversed. Valve 13 controls motor 14 which moves the entire post driving assembly 16 on the rack 15. Control valve 51 controls cylinder 20 which affects the alignment of vertical post 22 and ultimately the position of the highway post 39 in the ground. Likewise, valve 52 controls hydraulic cylinder 20*a* which affects the alignment of the highway post 39 in a plane at right angles to that controlled by cylinder 20. Valve 53 controls hydraulic motor 21 which is used to move column 22 in an upward or downward direction. All of these cylinders and the valves are connected to line 54 to return fluid to hydraulic reservoir 12.

In operation, the arm 18 is manually positioned on the appropriate side of the flatbed truck 10 and its position may be changed by moving it on the rack 15 by motor 14 which is operated by means of valve 13. The highway post 39 is placed in the guides 23—23 and the column 22 is lowered to the ground by means of motor 21, operated by valve 53. In doing so, the arm 18 is forced slightly upwards so that the weight of the flatbed truck 10 is added to hold the column 22 against the ground. The highway post 39 will have been previously positioned on the ground and the vertical alignment of the highway post 39 is achieved in two planes prior to that positioning by means of two bubble levels (not shown) which may be observed visually and by means of adjustment of hydraulic cylinders 20 and 20*a*, using valves 51 and 52. Then the guide rollers 25—25 are closed on the base of the highway post 39 by means of cylinder 26 operated by valve 50. The hydraulic hammer 24 then is actuated by operating valve 30 and this hammer repetively hits the top of highway post 39 and forces the highway post 39 into the ground a predetermined distance which is marked on the post and visually observed by the operator. After the post has been forced into the ground, guide rollers 25—25 are disconnected by means of hydraulic cylinder 26 operated by valve 50 and the motor 21 is actuated to rotate in a counter clockwise direction as viewed in FIG. 2 by means of valve 53, in order to cause the column 22 to rise an appropriate distance from the ground lifting with it guides 23—23 and then the process is repeated.

While this invention has been described with respect to flexible fiberglass posts, it will be seen that this invention can also be used to drive steel posts or posts made of other materials into the ground with modifications of the guides 23—23 and guide rollers 25—25 to fit the cross-sectional design of other types of posts.

While this invention has been described in its preferred embodiment, it is to be appreciated that variations therefrom may be made without departing from the true scope and spirit of the invention.

What is claimed:

1. A device for forcing a flexible reflective highway post into the ground in a vertical position comprising:

a mobile platform, a vertical column spaced from and supported by said mobile platform, guide means slidably mounted on said vertical column and adapted to hold a flexible reflective highway post in a vertical position and adapted to prevent said highway post from bending and flexing while said post is forced into the ground, means for mounting said guide means out of said ground at all times, means mounted on said guide means for forcing said post into the ground, and means for moving said vertical column in a vertical direction and including means for raising both said vertical column and said guide means when said reflective highway post has been forced a sufficient distance into the ground.

2. The device of claim 1 wherein said mobile platform contains a source of fluid under compression.

3. The device of claim 2 wherein said means for forcing said post into the ground is fluid actuated.

4. The device of claim 2 wherein said means for moving said vertical column is fluid actuated.

5. The device of claim 2 comprising fluid actuated rollers holding the lower portion of said reflective highway post in a vertical position while said post is forced into the ground.

6. The device of claim 1 comprising means for moving the vertical column in a horizontal direction.

7. The device of claim 1 comprising means for adjusting the alignment of said vertical column so that it is in a vertical position in a first vertical plane.

8. The device of claim 7 comprising means for adjusting alignment of said vertical column so that it is in a vertical position in a second vertical plane at right angles to said first vertical plane.

* * * * *